United States Patent [19]

Uke

[11] Patent Number: 4,870,550

[45] Date of Patent: Sep. 26, 1989

[54] WATERPROOF FLASHLIGHT

[76] Inventor: Alan K. Uke, 5980 Rancho Diegueno, P.O. Box 8531, Rancho Santa Fe, Calif. 92067

[21] Appl. No.: 149,533

[22] Filed: Jan. 28, 1988

[51] Int. Cl.[4] ..... F21L 7/00

[52] U.S. Cl. ..... 362/158; 362/187; 362/202

[58] Field of Search ..... 362/157, 158, 204, 205, 362/187, 197, 200, 202, 267; 200/60

[56] References Cited

U.S. PATENT DOCUMENTS

| | | | |
|---|---|---|---|
| 3,124,306 | 3/1964 | Schotz | 362/157 |
| 4,531,178 | 7/1985 | Uke | 362/158 |
| 4,570,208 | 2/1986 | Sarrmannscharren | 362/187 |
| 4,656,565 | 4/1987 | Maglica | 362/187 |
| 4,658,336 | 4/1987 | Maglica | 362/205 |

FOREIGN PATENT DOCUMENTS

| | | | |
|---|---|---|---|
| 1168408 | 10/1969 | United Kingdom | 362/205 |

*Primary Examiner*—Ira S. Lazarus

*Assistant Examiner*—D. M. Cox

*Attorney, Agent, or Firm*—Brown, Martin, Maller & McClain

[57] ABSTRACT

A compact battery-powered flashlight adapted for underwater use which includes a casing, an illumination unit, a sealant device and a connection device. The casing is hollow and substantially oval in cross section while having a closed rear end and a head receiving forward end. The head receiving forward end of the casing has a hollow outwardly protruding cylindrical neck. The casing further is adapted to receive at least two parallel adjacent rows of batteries with at least one battery per row. The casing neck is axially aligned with one of the rows of received batteries. The illumination unit is mounted upon the neck and generates light upon electrical connection to the batteries. The sealant device is disposed between the illumination unit and the neck for providing a watertight seal therebetween. The connection device is used to electrically connect the illumination device to the batteries received within the casing.

16 Claims, 1 Drawing Sheet

WATERPROOF FLASHLIGHT

BACKGROUND OF THE INVENTION

I. Field of the Invention

The present invention relates to underwater flashlights. More specifically, the present invention relates to a novel and improved compact, battery-powered diver's flashlight adapted for underwater use and configured for ease in handling and storage.

II. Background Art

The usual reduced visibility encountered underwater requires a source of light if a diver is to perform useful work. Because of the breathing equipment worn and protective clothing often required by a diver, his mobility and manual dexterity are severely reduced. These factors necessitate that the light source be rugged, easily held and simple to use. Finally, the electrical conductivity and pressure of the diver's water environment require exceptional watertight integrity to permit reliable operation of a light source underwater. An underwater flashlight is capable of providing the necessary illumination under most circumstances provided that it is rugged and easy to carry, versatile in producing an appropriate beam pattern, and has secure watertight integrity including the switching arrangement. Since diving operations are often conducted at remote sites, far from sources of supply, it is desirable that a flashlight for divers be easy to repair and rechargeable from a generally available electrical power source.

Constructions for divers' flashlights have been provided using waterproof covers with control switches operated through seals. However, such seals wear and leak after a period of use. Parts removable from the flashlight, and openings in the flashlight such as battery charging connections must be sealed. The latter requirement poses problems servicing a diver's flashlight since the seals are often damaged or destroyed in use and are difficult to remake.

Applicant of the present invention bas solved many of the shortcomings of prior art devices by device disclosed in his U.S. Pat. No. 4,531,178 entitled "DIVER'S FLASHLIGHT" issued July 23, 1985, disclosure which is incorporated by reference herein. Applicant's invention previously patented provided the operational features and characteristics desired in an underwater flashlight while at the same time eliminating or minimizing the noted hazards in providing a diver's flashlight capable of continued effective use and easy servicing. The present invention provides an improvement of Applicant's previously patented invention by providing a diver's flashlight with features of ease in handling, carrying, and storage.

It is, therefore, an object of the present invention to provide a novel and improved configuration for a diver's flashlight.

SUMMARY OF THE INVENTION

The waterproof flashlight described herein provides a strong focusable light beam while overcoming the problems of prior devices. It includes an elongated hollow casing of substantially oval cross-section having one end closed and the other end partially open. A hollow, outwardly protruding cylindrical neck is formed at the other end and provides an opening into the interior of the casing. First and second adjacent parallel rows of batteries are positioned within the casing with each row of batteries being in axial alignment in a longitudinal end to end arrangement. Opposite polarity terminals contact between the batteries in each row. The first row of batteries are axially aligned with the neck.

A first connector strip is positioned along the rear or closed end wall of the casing and electrically contacts one polarity terminal of a battery in the second row of batteries. A spring is integrally formed with the first connector strip and connects an opposite polarity terminal of a battery in the first row to the one polarity terminal of the battery in the first row via the first connecting strip. The spring urges the batteries in the neck aligned row toward the opening of the neck. A second connector strip is positioned along an inner side wall of the neck and includes a first contact portion adjacent the opening of the neck. The second connector strip includes a spring biased second contact portion which contacts the opposite polarity terminal of the other battery in the second row of batteries.

A cylindrical barrel having a light window at one end is in threaded watertight engagement with the open end of the neck. The barrel houses a reflector block which is urged by the spring against the window. The reflector block includes a halogen bulb and a faceted reflecting surface. A resilient washer spaced between the reflector block and a conduction cap which surrounds the bulb. The bulb is energized when the barrel is threaded into an on position on the neck. In the on position, the bulb circuit is completed with the batteries coupled to the bulb through the second connector strip which contact the conduction cap with the other battery in the first row contacting the bulb. The barrel action thus performs as the flashlight switch as well as sealing the open end of the casing. The washer and conduction cap permit adjustment of the bulb position with respect to the reflector to focus the beam in conjunction with the barrel's sealing and switching function.

BRIEF DESCRIPTION OF THE DRAWINGS

The just described features, objects, and advantages of the present invention, along with others, will be more fully apparent from the detailed description set forth below taken in conjunction with the drawings in which like reference characters identify correspondingly throughout and wherein.

DETAILED DESCRIPTION OF THE PREFERRED EMBODIMENTS

Figure 1:
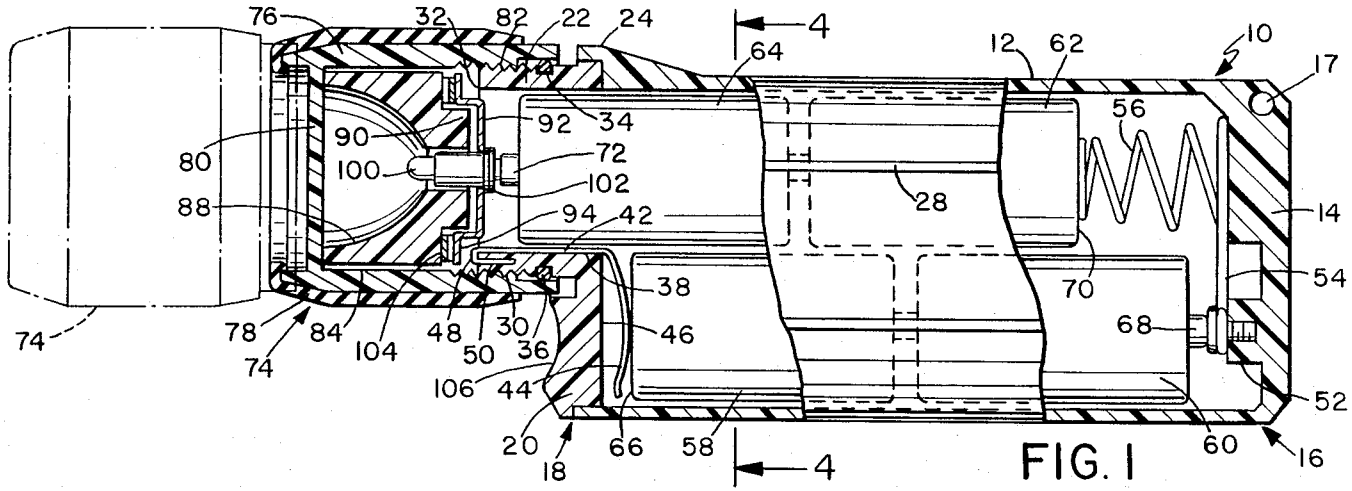
FIG. 1 is a side elevation view, partially cut away, illustrating the improved diver's flashlight of the present invention.

Referring to FIG. 1 of the drawings, flashlight 10 includes an elongated hollow casing 12 of substantially oval cross-section. Casing 12 includes a rear case wall 14 formed at a rear end 16 of casing 12 which closes end 16. Hole 17 is formed in rear case wall 16 to permit a lanyard to be attached to case 12. Hole 17 extends through rear case wall only and does not extend into the hollow interior of casing 12. The other end of casing 12, end 18, is open. A front case wall is mounted at end 18. Front case wall 20 has a hollow outwardly protruding cylindrical neck 22 formed at an upper portion thereof. Casing 12 is preferably manufactured from a tough plastic material such as Lexan and may be transparent, translucent or opaque. Flange 24 is formed near open end 18 of casing 12 adjacent where neck 22 is positioned. The casing may include ribs 28 to provide a good gripping surface for the diver to hold flashlight 10.

Figure 2:
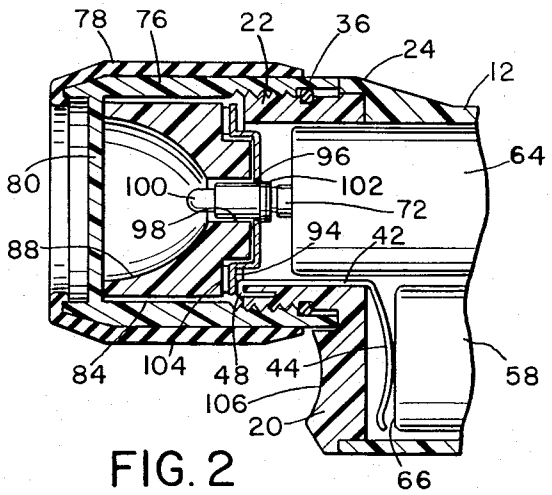
FIG. 2 is a portion of FIG. 1 cut away illustrating the flashlight head seated on the casing neck, with a portion cut away, in the on position.

Referring to FIGS. 1 and 2, external screw threads 30 are formed adjacent open end 32 of neck 22 opposite the coupling of wall 20 to end 18. An annular groove 34 is formed in along the outer surface of neck 32 adjacent threads 30. Groove 34 seats a resilient sealing ring or O-ring 36.

Neck 22 includes an elongated internal groove 30 extending from open end 38 to the interior of case 12. A connector strip 42 of an electrically conductive material is disposed within groove 38. A spring biased contact portion or leg 44 extends at an angle to strip portion 42 adjacent an inner face 46 of wall 20. A substantially U-shaped contact portion 48 is formed on the opposite end of the strip portion 42 from leg 44. When connector strip 42 is inserted in place in groove 38, contact portion 48 seats in slot 50 formed in the edge of the open end 32 of neck 22, and leg 44 is positioned adjacent face 46 of the wall 20. Contact portion 48 fits snugly into place in the slot 50 and overlaps a portion of the edge of open end 30 of neck 22. Positioned at an inner face 52 of wall 14 is connector strip 54.

Connector strip 54 includes an integrally formed spring portion 56 which is positioned in an upper portion of the interior of casing 12 adjacent wall 14 and alignably facing neck opening 32. As illustrated in FIG. 1, batteries 58, 60, 62 and 64 are mounted within casing 12. Batteries 58, 60, 62 and 64 are typically rechargeable batteries. Batteries 58 and 60 are axially positioned in axial alignment in an end to end relationship in a lower portion of casing 12. The outer end terminals 66 and 68 of batteries 58 and 60 respectively contact leg 44 and connector strip 52. Batteries 62 and 64 are positioned in axial alignment in end to end relationship in an upper portion. The outer end terminals 70 and 72 are of batteries 62 and 64 has terminals 72 contacting spring portion 56. Batteries 62 and 64 are also in axial alignment with neck 22. Batteries 58 and 60 form a lower row while batteries 62 and 64 form an upper row parallel to the lower row of batteries. Individual batteries are inserted into the casing 12 through the open end 32 of neck 22.

The flashlight head 74 is illustrated in FIG. 1 in dashed lines as being separated from casing 12. Head 74 incorporates lamp focusing and alignment features. Head 74 includes a cylindrical flashlight barrel 76 and an outer rubber housing 78. Lamp reflector block 86 positioned within barrel 76. In FIGS. 1 and 2 barrel 76 is depicted as being threaded upon the neck 22.

Barrel 74 has a transparent end window 80 at one end, internal threads 82 adjacent an open opposite, and a smooth internal bore portion 84 there between. A cylindrical reflector block 86 is housed within barrel 74 and has a substantially parabolic reflector cavity surface 88 formed therein. Facets formed on surface 88 serve to form an even beam with less parabolic curvature. Reflector block 88 is formed with an annular shoulder portion 90 at the end opposite the reflector.

A conducting cap 92 fits slideably over the shoulder portion 90 and has a rim 94 for providing an electrical contact surface for cap 92. The shoulder portion 90 of block 80 and cap 92 have in-line cylindrical apertures 96 and 98 respectively. A socket-type halogen bulb 100 is mounted in the cap aperture 98 with a friction fit. The bulb 100 extends through the aperture 96 into the reflector cavity towards the head focal point.

The positive terminal 102 of the bulb is aligned with terminal 70 of battery 72. An annular resilient wave washer 104 is interposed between the cap rim 94 and the reflector block 74. The compressible undulations of the washer 104 provide spring action tending to hold cap 92 away from reflector block 80. The spring action, in conjunction with the slideably fit of cap 92 on block 80, provides for a longitudinal movement of the bulb toward and away from the focal of reflector cavity 88.

To operate flashlight 10 illustrated in FIGS. 1 and 2, barrel 76 is threaded upon neck 22. In FIG. 2, bulb 100 is energized by the battery electrical potential being applied to bulb 100 when connector portion 48 is urged into contact with conductive cap rim, 94 by barrel 76 being threaded upon the neck 12. When the latter contact is first made, bulb 100 is energized, but the filament is not positioned at the focal point of the reflector. As a result, a diffused light beam is formed by the flashlight. Further threading of the barrel 76 upon the neck 22 engages casing flange 24. This engagement compresses resilient washer 104 and positions the lamp filament at the focal point of the reflector so as to produce a parallel uniform flashlight beam. Therefore, the barrel action performs a beam focusing function as well as a switching and sealing function. It is further envisioned that a finger switch may be positioned on a finger gripping surface or front face 106 of front wall 20 below neck 22.

Figure 4:
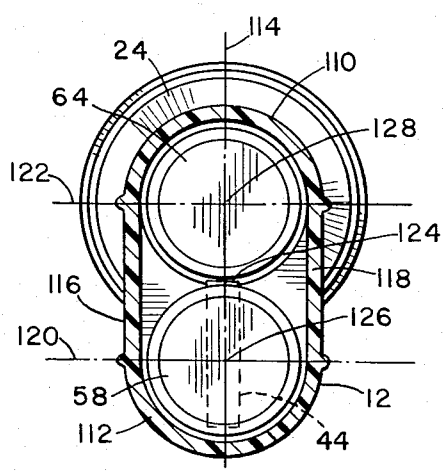
FIG. 4 is a sectional view taken along line 4-4 of FIG. 1 illustrating a rearward view of battery positioning within the flashlight casing.
Figure 3:
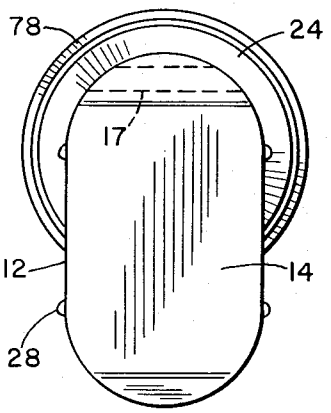
FIG. 3 is a rear end view of the flashlight of FIG. 1.

FIGS. 3 and 4 illustrate rear views of flashlight 10 with a portion cut away in FIG. 4. In FIGS. 3 and 4, the cross-section of case 12 has curved upper and lower portions 110 and 112 centered on a vertical major axis 114 and parallel side wall portions 116 and 118 interconnect upper and lower portion 110 and 112. A pair of minor axis 120 and 122 are perpendicular to major axis 114 and are equidistantly spaced from casing center point 124 on major axis 114. Axis 120 and 122 respectively intersect with axis 114 at points 126 and 128. The roW of batteries 58 and 60 are axially aligned with a longitudinal axis that extends perpendicular to axis 114 and 120 and through point 128. The row of batteries 62 and 64 are axially aligned with a longitudinal axis that extends perpendicular to axis 114 and 122 through point 128. The axis running through points 128 and 126 are perpendicular to one another. The axis extending through point 128 is a central axis to neck 12.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein, but is to be accorded the widest scope consistent with the principles and novel features disclosed herein.

I claim:

1. A flashlight for receiving batteries therein and adapted for underwater use, comprising:

a hollow casing being substantially oval in cross-section and having a closed rear end and a head receiving forward end, said head receiving end having first and second portions, said first portion having a hollow outwardly protruding cylindrical neck formed thereat and said second portion having an end wall formed thereat, said casing for receiving at least two parallel adjacent rows of batteries with at least one battery positioned in each row, and said neck axially aligned with one of said battery rows and said end wall facing at least another one of said battery rows;

illumination means mounted upon said neck for, receiving electrical power from said batteries and generating light;

sealant means disposed between said illumination means and said neck for providing a watertight seal between said illumination means and said neck; and connection means for electrically connecting said illumination means to said batteries.

2. The flashlight of claim 1 wherein said illumination means comprises:

a hollow, substantially cylindrical barrel having a transparent window at one end and open at the other end;

a light bulb;

reflector means, positioned within said barrel, for receiving said light bulb and for reflecting light generated by said light bulb through said window; and wherein said barrel is mounted at said barrel open end upon said neck.

3. The flashlight of claim 2 wherein said barrel includes internal threads formed adjacent said barrel open end and said neck has externally formed mating threads for making with said barrel threads.

4. The flashlight of claim 2 wherein said reflector means comprises a cylindrical reflector block having a parabolic reflecting surface facing said window, said reflecting surfacing having a plurality of facets formed therein.

5. The flashlight of claim 1 wherein said sealant means comprises an O-ring positioned on said neck.

6. The flashlight of claim 1 wherein said connection means comprises:

manually operable means for telescopically moving said illumination means along a longitudinal axis of said neck;

contact means responsive to the position of said illumination means upon said neck for selectively electrically coupling said illumination means to batteries received within said casing.

7. The flashlight of claim 1 wherein said casing further comprises:

an elongated continuous side wall, substantially oval in cross-section and defining a hollow interior, said side wall having an open forward end and a closed rear end, said rear end closed by a rear end wall integrally formed with said side wall; and a forward end wall mounted at said side wall open forward end, said forward end wall defining first and second forward end wall portions with said first forward end wall portion having a hollow outwardly protruding cylindrical neck formed thereat and said second forward end wall portion enclosing said case interior and having an outer gripping surface.

8. A compact, battery-powered underwater flashlight comprising:

an elongated hollow casing substantially oval in cross-section and having a closed rear end and a partially closed head receiving forward end, said head receiving end having an upper portion with a hollow outwardly protruding cylindrical neck with an outer open end and a lower portion with an end wall substantially perpendicular to said side wall and having an outer gripping surface, said casing for receiving two parallel adjacent rows of at least one battery per row, and said neck axially aligned with one of said batteries rows;

a hollow, substantially cylindrical barrel having a transparent window at one end and having an open other end;

a cylindrical reflector positioned within said barrel having a substantially parabolic reflective surface facing said window and a central axial throughbore;

a light bulb positioned in said reflector throughbore;

coupling means for movably coupling, along a common longitudinal axis, said barrel adjacent said barrel open end upon said neck adjacent said neck outer open end in a telescopic arrangement;

sealant means positioned between said barrel and said neck for providing a watertight seal therebetween; and connection means responsive to the relative positioning of said barrel upon said neck for electrically connecting and disconnecting said light bulb with batteries received within said casing.

9. The flashlight of claim 8 wherein said case further comprises a plurality of ridges longitudinally formed on an outer surface of said casing.

10. The flashlight of claim 8 wherein said coupling means comprises internal threads formed on said barrel and external threads formed on said neck for mating with said barrel internal threads.

11. The flashlight of claim 8 wherein said sealant means comprises an O-ring positioned on said neck.

12. In a compact, battery-powered underwater flashlight having a hollow casing for holding batteries and with a threaded neck for positioning a flashlight head thereupon where the head comprises a hollow, substantially cylindrical barrel having a transparent window at one end and open at another end, a cylindrical reflector positioned with the barrel that has a substantially parabolic reflective surface facing the window and a central axial throughbore, a light bulb positioned in said reflector throughbore, said barrel being internally threaded adjacent said barrel open end for mating with the threaded neck, an O-ring disposed between said barrel and said neck; and means disposed within the casing for electrically connecting batteries received within the casing with the light bulb wherein the improvement comprises;

said casing being substantially oval in cross-section and having a closed rear end and a partially closed head receiving end with the head receiving end having first and second portions, said first portion having a hollow, outwardly protruding, externally threaded cylindrical neck formed thereat for receiving said barrel and said second portion having an end wall, said casing for receiving two parallel adjacent rows of two batteries, with one row of batteries sharing a common longitudinal axis with said neck and said end wall facing at least another one of said battery rows.

13. The flashlight of claim 12 wherein said casing further comprises an elongated side wall substantially oval in cross-section and defining a hollow interior, said side wall having a forward end and a rearward end;

a rear end wall integrally formed with said side wall at said rearward end so as to close said side wall rearward end;

a forward end wall mounted at said forward end, said forward wall having said neck formed at said head receiving end first portion and said forward end wall enclosing said case interior and having an outer gripping surface.

14. The flashlight of claim 12 wherein said casing oval cross-section is defined by a major axis and a pair of minor axes perpendicular to said major axis each intersecting said major axis at equal distance from a center point of said cross section along said major axis, said casing further defining a pair of longitudinal axes each perpendicular to said major axis and extending longitudinally through said casing with said neck longitudinally aligned along one of said longitudinal axis and each row of batteries being positioned in axial alignment with a different one of said longitudinal axis.

15. The flashlight of claim 10 wherein said sealant means comprises an O-ring positioned on said neck.

16. The flashlight of claim 15 wherein said case further comprises a plurality of ridges longitudinally formed on an outer surface of said casing.

* * * * *